US011226157B2

(12) United States Patent
Goto et al.

(10) Patent No.: US 11,226,157 B2
(45) Date of Patent: Jan. 18, 2022

(54) PAINT DRYING DEVICE

(71) Applicant: Taikisha Ltd., Tokyo (JP)

(72) Inventors: Masayuki Goto, Tokyo (JP); Toshihiko Koike, Tokyo (JP); Hisao Nakajima, Tokyo (JP)

(73) Assignee: Taikisha Ltd., Tokyo (JP)

( * ) Notice: Subject to any disclaimer, the term of this patent is extended or adjusted under 35 U.S.C. 154(b) by 0 days.

(21) Appl. No.: 17/051,743

(22) PCT Filed: Jul. 8, 2020

(86) PCT No.: PCT/JP2020/026738
§ 371 (c)(1),
(2) Date: Oct. 29, 2020

(87) PCT Pub. No.: WO2021/039140
PCT Pub. Date: Mar. 4, 2021

(65) Prior Publication Data

US 2021/0247137 A1 Aug. 12, 2021

(30) Foreign Application Priority Data

Aug. 29, 2019 (JP) ..... JP2019-157279

(51) Int. Cl.
*F26B 19/00* (2006.01)
*F26B 15/16* (2006.01)
*F26B 3/04* (2006.01)
*F26B 21/00* (2006.01)

(52) U.S. Cl.
CPC ..... *F26B 15/16* (2013.01); *F26B 3/04* (2013.01); *F26B 21/004* (2013.01)

(58) Field of Classification Search
CPC ..... F26B 15/16; F26B 3/04; F26B 21/004
USPC ..... 34/666
See application file for complete search history.

(56) References Cited

U.S. PATENT DOCUMENTS 4,291,472 A * 9/1981 Lewis ..... F26B 21/02 34/212
2018/0120028 A1* 5/2018 Robbin ..... B62D 65/18
2019/0217320 A1* 7/2019 Schulze ..... B05D 3/02

FOREIGN PATENT DOCUMENTS

JP H4118168 U 10/1992
JP H4118171 U 10/1992
JP H8266982 A 10/1996

* cited by examiner

*Primary Examiner* — John P McCormack
(74) *Attorney, Agent, or Firm* — The Webb Law Firm

(57) ABSTRACT

A paint drying device where leakage of air between a drying chamber and a driving section accommodating chamber is prevented reliably. In the paint drying device in which the drying chamber and the driving section accommodating chamber communicate with each other via a through hole through which a power transmission tool extends, there are provided an air feeding passage for feeding air present outside the drying chamber to the driving section accommodating chamber by an air feeding fan and an exhaust passage for discharging air in the driving section accommodating chamber to the outside of the drying chamber by an exhaust fan. An air amount adjustment device is provided for adjusting a ratio between an amount of air to be fed to the driving section accommodating chamber via the air feeding passage and an amount of air to be discharged from the driving section accommodating chamber via the exhaust passage.

10 Claims, 6 Drawing Sheets

PAINT DRYING DEVICE

CROSS-REFERENCE TO RELATED APPLICATIONS

This application is the United States national phase of International Application No. PCT/JP2020/026738 filed Jul. 8, 2020, and claims priority to Japanese Patent Application No. 2019-157279 filed Aug. 29, 2019, the disclosures of which are hereby incorporated by reference in their entirety.

TECHNICAL FIELD

This invention relates to a paint drying device for effecting a drying treatment of a paint film formed on a surface of a work, subsequent to a painting process of forming such paint film on the surface of the work such as an automobile body.

More particularly, the invention relates to a paint drying device wherein:

a drying chamber is provided for accommodating a work having a paint film formed on its surface;

in the drying chamber, there are mounted a heater device for heating and drying the paint film and a conveyer device for moving the work;

the conveyer device includes a driving section for generating a conveying power, and a power transmission tool configured to transmit the conveying power to the work while moving together with the work by the conveying power generated by the driving section;

a driving section accommodating chamber is provided for accommodating the driving section by surrounding it, the drying chamber and the driving section accommodating chamber being communicated to each other via a through hole through which the power transmission tool is extended; and the through hole is provided in form of a slit extending continuously along a movement path of the work in the drying chamber in order to allow the movement of the power transmission tool with the work.

RELATED ART

Conventionally, with this kind of paint drying device (see FIG. 1 and FIG. 4), hot air present inside the drying chamber 1 may leak through the through hole 11 into the driving section accommodating chamber 4 of the conveyer device 3. For the purpose of preventing heating of the driving section accommodating chamber 4 due to such leak of hot air thereto, there has been proposed a paint drying device configured to discharge air (A) in the driving section accommodating chamber 4 to the outside through an exhaust passage (fe) by an exhaust fan (Fe) (see Patent Document 1).

Further, independently of the above, for the purpose of preventing heat loss due to leakage of hot air inside a drying chamber 1 via a through hole 11 into the driving section accommodating chamber 4 of the conveyer device 3, there has been proposed also a paint drying device configured to feed air (A) outside the drying chamber 4 into the driving section accommodating chamber 4 via an air feeding passage (fs) by an air feeding fan (Fs) (see Patent Document 2).

Incidentally, in the case of the latter-mentioned paint drying device, when a pressure (p1) of air in the drying chamber 1 exceeds a pressure (p4) of air in the driving section accommodating chamber 4, the output of the air feeding fan (Fs) is increased so as to increase the amount (qs) of air to be fed into the driving section accommodating chamber 4 via the air feeding passage (fs).

Conversely, when the pressure (p1) of air in the drying chamber 1 falls below the pressure (p4) of air in the driving section accommodating chamber 4, the output of the air feeding fan (Fs) is decreased so as to decrease the amount (qs) of the air (A) to be fed into the driving section accommodating chamber 4 via the air feeding passage (fs).

RELATED ART DOCUMENTS

Patent Documents

Patent Document 1: Japanese Unexamined Utility Model Application Publication Hei. 4-118171

Patent Document 2: Japanese Unexamined Patent Application Publication Hei. 8-266982

SUMMARY

Problems to be Solved by Invention

However (see FIGS. 1 and 4 again), in the case of the former-mentioned paint drying device configured to discharge air (A) in the driving section accommodating chamber 4 to the outside by the exhaust fan (Fe), in association with the exhaust of air (A) of the driving section accommodating chamber 4, the leakage of hot air from the drying chamber 1 to the driving section accommodating chamber 4 via the through hole 11 is promoted rather than suppressed. And, due to this, such problems as following problems (a) through (c) occur.

(a) Heating of the driving section accommodating chamber 4 cannot be prevented sufficiently. Due to this, heat damage or heat deterioration of a driving instrument such as an electric motor, a transmission device accommodated in the driving section accommodating chamber 4 tends to be invited.

(b) As heat loss of the drying chamber 1 increases due to leakage of hot air, the amount of energy required for maintaining the drying chamber 1 under a required hot atmosphere increases, thus increasing the running cost of the device.

(c) Dust or tar component generated in the drying chamber 1 will enter the driving section accommodating chamber 4 together with the hot air. Thus, the burden of maintenance for the driving section accommodating chamber 4 will increase.

On the other hand, in the case of the latter-mentioned paint drying device configured to feed air (A) outside the drying chamber 1 into the driving section accommodating chamber 4 by the air feeding fan (Fs), the through hole 11 acts as a main escape passage for the air (A) fed into the driving section accommodating chamber 4 by the air feeding fan (Fs). Thus, even if the output of the air feeding fan (Fs) is adjusted to maintain the pressure (p1) of the air inside the drying chamber 1 equal to the pressure (p4) of the air in the driving section accommodating chamber 4, strictly speaking, there tends to occur a tendency of the air (A) fed into the driving section accommodating chamber 4 by the air feeding fan (Fs) to enter, though in a small amount, the drying chamber 1 via the through hole 11. Due to this, such problems as following problems (d) through (f) occur.

(d) As air having a relatively low temperature flows into the drying chamber 1 via the through hole 11, the tar component present in the hot air in the drying chamber 1 will condense in the through hole 11 or its surrounding, and the burden of maintenance will increase to remove this condensed tar component (i.e. tar).

(e) As air having a relatively low temperature flows into the drying chamber 1, the heat load to the heater device 2 in the drying chamber 1 will increase. Thus, the amount of energy required for maintaining the drying chamber 1 under a required hot air atmosphere increases, thus increasing the running cost of the device.

(f) Dust, etc. generated in the driving section accommodating chamber 4 enters the drying chamber 1 through the through hole 11 together with air (A) and the entered dust, etc. will adhere to the work (W). Thus, the painting finish quality of the work (W) deteriorates.

In view of the above-described state of the art, the principal object of the present invention is to solve the above-described problems effectively by employing a reasonable arrangement.

Solutions (1) A paint drying device according to the present invention, wherein:

a drying chamber is provided for accommodating a work having a paint film formed on its surface;

in the drying chamber, there are mounted a heater device for heating and drying the paint film and a conveyer device for moving the work;

the conveyer device includes a driving section for generating a conveying power, and a power transmission tool configured to transmit the conveying power to the work while moving together with the work by the conveying power generated by the driving section;

a driving section accommodating chamber is provided for accommodating the driving section by surrounding it, the drying chamber and the driving section accommodating chamber being communicated to each other via a through hole through which the power transmission tool is extended; and the through hole is provided in form of a slit extending continuously along a movement path of the work in the drying chamber in order to allow the movement of the power transmission tool with the work;

wherein an air feeding passage is provided for feeding air present outside the drying chamber to the driving section accommodating chamber by an air feeding fan;

an exhaust passage is provided for exhausting air present inside the driving section accommodating chamber to the outside of the drying chamber by an exhaust fan; and an air amount ratio adjustment device is provided for adjusting a ratio between the amount of air fed to the driving section accommodating chamber via the air feeding passage and the amount of air exhausted from the driving section accommodating chamber via the exhaust passage.

Namely, with the paint drying device according to the present invention (see FIG. 4), a ratio between the amount of air (qs) fed to the driving section accommodating chamber 4 via the air feeding passage (fs) by the air feeding fan (Fs) and the amount of air (qe) exhausted from the driving section accommodating chamber 4 via the exhaust passage (fe) by the exhaust fan (Fe) is adjusted by an air amount ratio adjustment device (Qse).

And, through the adjustment of the air amount ratio by this air amount ratio adjustment device (Qse), the pressure (p4) of air in the driving section accommodating chamber 4 is adjusted to be equalized with the pressure (p1) of air in the drying chamber 1. With this, leakage of hot air into the driving section accommodating chamber 4 from the drying chamber 1 via the through hole 11 and inflow of air from the driving section accommodating chamber 4 to the drying chamber 1 via the through hole 11 are prevented.

In this, with the paint drying device according to the present invention, in addition to feeding of air (A) present outside the drying chamber 1 to the driving section accommodating chamber 4 via the air feeding passage (fs) by the air feeding fan (Fs), in operative association with this air feeding, the air (A) present in the driving section accommodating chamber 4 is exhausted to the outside of the drying chamber 1 through the exhaust passage (fe) by the exhaust fan (Fe). Therefore, it is possible to avoid the tendency of the air (A) fed to the driving section accommodating chamber 4 by the air feeding fan (Fs) leaking, though small in amount, to the drying chamber 1 through the through hole 11, as would occur with the paint drying device configured only to feed air (A) to the driving section accommodating chamber 4 by the air feeding fan (Fs) (Patent Document 2).

For this reason, with the paint drying device according to the present invention, as compared with the paint drying devices proposed respectively in Patent Documents 1 and 2 described above, both the leakage of hot air into the driving section accommodating chamber 4 from the drying chamber 1 via the through hole 11 and the inflow of air into the drying chamber 1 from the driving section accommodating chamber 4 via the through hole 11 can be prevented even more effectively and reliably.

Therefore, with the paint drying device according to the present invention, the problems (i.e. such as the problems (a)-(c) described above) due to leakage of hot air into the driving section accommodating chamber 4 from the drying chamber 1 via the through hole 11 can be solved in an effective manner.

Further, the problems (i.e. such as the problems (d)-(f) described above) due to inflow of air into the drying chamber 1 from the driving section accommodating chamber 4 via the through hole 11 can also be solved in an effective manner.

(2) According to one embodiment of the present invention:

a pressure equalization control device is provided for automatically equalizing the pressure of air in the driving section accommodating chamber with the pressure of air in the drying chamber by controlling the air amount ratio adjustment device based on detection information on the pressure of air in the driving section accommodating chamber and the pressure of air in the drying chamber.

In this case (see FIG. 4), equalization of the pressure (p4) of the air in the driving section accommodating chamber 4 and the pressure (p1) of the air in the drying chamber 1 is effected automatically by the pressure equalization control device. Thus, the leakage of hot air into the driving section accommodating chamber 4 from the drying chamber 1 via the through hole 11 and the inflow of air into the drying chamber 1 from the driving section accommodating chamber 4 via the through hole 11 can be prevented even more stably and reliably.

(3) According to one embodiment of the present invention:

an outlet for forming air curtain and an inlet for forming the air curtain are disposed opposite to each other and in distribution at a hole edge portion on one side in a hole width direction of the through hole and at a hole edge portion on the other side in the hole width direction of the through hole; and there is provided an air curtain device configured to discharge a portion of the air fed from the air feeding fan via the air curtain forming outlet and to take in a portion of the air taken in by the exhaust fan via the air curtain forming inlet.

In this case (see FIG. 4), the above-described air curtain device (C) forms an air flow curtain (Ac) which transverses the through hole 11. Thanks to the shielding effect provided by the air flow curtain (Ac), in addition to the pressure equalization between the driving section accommodating chamber 4 and the drying chamber 1 by the air amount ratio adjustment device (Qse), the leakage of hot air into the driving section accommodating chamber 4 from the drying chamber 1 via the through hole 11 and the inflow of air into the drying chamber 1 from the driving section accommodating chamber 4 via the through hole 11 can be prevented even more effectively.

And, in this case, under the condition of pressure equalization established between the driving section accommodating chamber 4 and the drying chamber 1, intrusion of dust or the like generated in the drying chamber 1 by dropping into the driving section accommodating chamber 4 via the through hole 11 as well as intrusion of dust or the like generated in the driving section accommodating chamber 4 into the drying chamber 1 via the through hole 11 by being stirred up can be effectively prevented by the air curtain device (C).

(4) According to one embodiment of the present invention:

inlets for sealing are disposed respectively at the hole edge portion on one side in the hole width direction of the through hole and at the hole edge portion on the other side; and there is provided an air seal device into which a portion of air introduced by the exhaust fan is sucked into the respective sealing inlet.

In this case (see FIG. 5), as the sealing inlets 15*b* on one side and the other side of the air seal device (S) provide suction action to the through hole 11 in their layout opposed to each other across the through hole 11. With this, in addition to the pressure equalization between the driving section accommodating chamber 4 and the drying chamber 1 by the air amount ratio adjustment device (Qse), the leakage of hot air into the driving section accommodating chamber 4 from the drying chamber 1 via the through hole 11 and the inflow of air into the drying chamber 1 from the driving section accommodating chamber 4 via the through hole 11 can be prevented even more effectively.

And, in this case, under the condition of pressure equalization established between the driving section accommodating chamber 4 and the drying chamber 1, intrusion of dust or the like as dropping into the driving section accommodating chamber 4 via the through hole 11 and the intrusion of dust or the like generated in the driving section accommodating chamber 4 as being stirred up into the drying chamber 1 via the through hole 11 can also be prevented effectively by the air seal device (S).

(5) According to one embodiment of the present invention:

there are provided:

an adjacent seal member on one side which extends from the hole edge portion on one side in the hole width direction of the through hole to a position adjacent a movement path of the power transmission tool; and an adjacent seal member on the other wide which extends from the hole edge portion on the other side in the hole width direction of the through hole to a position adjacent the movement path of the power transmission tool.

In this case (FIG. 4), thanks to the receiving action for dust or the like provided by the adjacent seal members 18*a* and 18*b* on one side and the other side extending to positions adjacent the movement path of the power transmission tool 9, the intrusion of dust or the like from the drying chamber 1 to the driving section accommodating chamber 4 via the through hole 11 and the intrusion of dust or the like from the driving section accommodating chamber 4 to the drying chamber 1 via the through hole 11 can both be prevented effectively.

(6) According to one embodiment of the present invention:

a plurality of the one side adjacent seal member and the other side seal member respectively are provided in distribution in a hole depth direction of the through hole.

In this case (see FIG. 4), the intrusion of dust or the like from the drying chamber 1 to the driving section accommodating chamber 4 via the through hole 11 and the intrusion of dust or the like from the driving section accommodating chamber 4 to the drying chamber 1 via the through hole 11 can both be prevented effectively.

(7) According to one embodiment of the present invention:

a moving side seal member having a greater width than a hole width of the through hole is provided to the power transmission tool, at a position adjacent a hole opening of the through hole on the side of the drying chamber and/or a position adjacent a hole portion of the through hole on the side of the driving section accommodating chamber.

In this case (see FIG. 8), by the receiving action for dust or the like provided by the moving side seal member having a large width, the intrusion of dust or the like from the drying chamber 1 to the driving section accommodating chamber 4 via the through hole 11 and the intrusion of dust or the like from the driving section accommodating chamber 4 to the drying chamber 1 via the through hole 11 can both be prevented even more effectively.

Incidentally, preferably, the moving side seal member 22 should have a member length that can minimize the spacing formed between the rear end of the moving side seal member 22 provided to the power transmission tool 9 for a preceding work (W) and the front end of the moving side seal member 22 provided to the power transmission tool 9 for a succeeding work (W).

(8) According to one embodiment of the present invention:

a cover seal member which covers the moving side seal member as seen in the direction of movement of the power transmission tool is provided in continuation in the extending direction of the through hole and at a boundary wall portion between the drying chamber and the driving section accommodating chamber.

In this case (see FIG. 8), the passage for dust or the like is formed as a bent gap passage between the moving side seal member 22 and the cover seal member 23 as seen in the direction of movement of the power transmission tool 9, whereby the receiving effect for dust or the like provided by the moving side seal member 22 can be enhanced. With this, the intrusion of dust or the like from the drying chamber 1 to the driving section accommodating chamber 4 via the through hole 11 and the intrusion of dust or the like from the driving section accommodating chamber 4 to the drying chamber 1 via the through hole 11 can both be prevented even more effectively.

(9) According to one embodiment of the present invention:

at least a portion of the exhaust passage or at least a portion of the air feeding passage is disposed to be embedded in a boundary wall portion between the drying chamber and the driving section accommodating chamber.

In this case (see FIG. 1 and FIG. 4), in comparison with an arrangement in which the exhaust passage (fe) and the air feeding passage (fs) are formed of ducts exposed outside the boundary wall portion (K) (12*a*, 12*b*), the device arrangement around the driving section accommodating chamber 4 can be simplified and the paint drying device can be configured advantageous in terms of space.

(10) According to one embodiment of the present invention:

the boundary wall portion in which at least a portion of the exhaust passage or at least a portion of the air feeding passage is disposed to be embedded has a door arrangement or a lid arrangement which allows free opening and closing.

In this case (see FIG. 2), by opening the above-described boundary wall portion (K) (12*a*, 12*b*) having a door or lid arrangement to open up the inside of the driving section accommodating chamber 4 to the drying chamber 1, a maintenance work for a driving section 3*b* of the conveyer device 3 accommodated in the driving section accommodating chamber 4 can be carried out easily.

EMBODIMENTS

Figure 1:
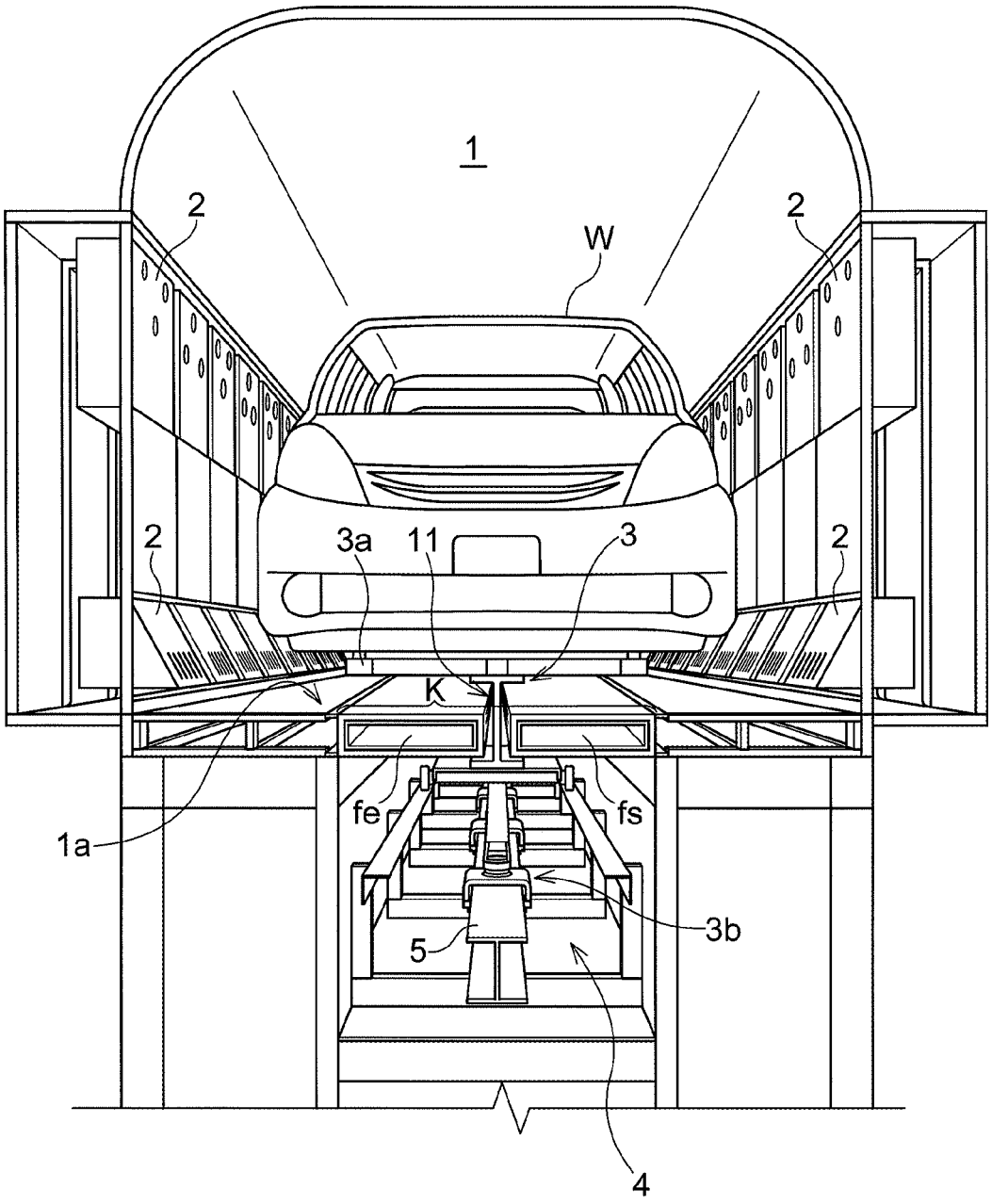
FIG. 1 is a horizontal section of a paint drying device.

FIG. 1 shows a paint drying device. With this paint drying device, at a painting step as a preliminary step, a work (W) (an automobile body in this embodiment) having a paint coating formed on its surface is accommodated in a tunnel-like drying chamber 1 and as the paint coating is heated by a heater device 2 of a hot air type or radiation type mounted in this drying chamber 1, the paint coating on the work (W) is dried.

In a bottom portion of the drying chamber 1, there is mounted a friction type conveyer device 3. In operation, the work (W) accommodated in the drying chamber 1 is mounted on a conveyer cart 3*a* and under this condition, the work (W) is conveyed by the conveyer device 3 through respective zones, from a temperature elevating zone located in the former half of the drying chamber 1 and in a temperature keeping zone located in the latter half of the same.

On the lower face side of a bottom wall 1*a* of the drying chamber 1, there is provided a driving section accommodating chamber 4 which accommodates the driving section 3*b* in such a manner as to surround this driving section 3*b* of the conveyer device 3. This driving section accommodating chamber 4 is provided to extend like a tunnel extending along a movement path of the work (W) in the drying chamber 1 and opposed end portions thereof in the extending direction of the driving section accommodating chamber 4 are closed.

Figure 3:
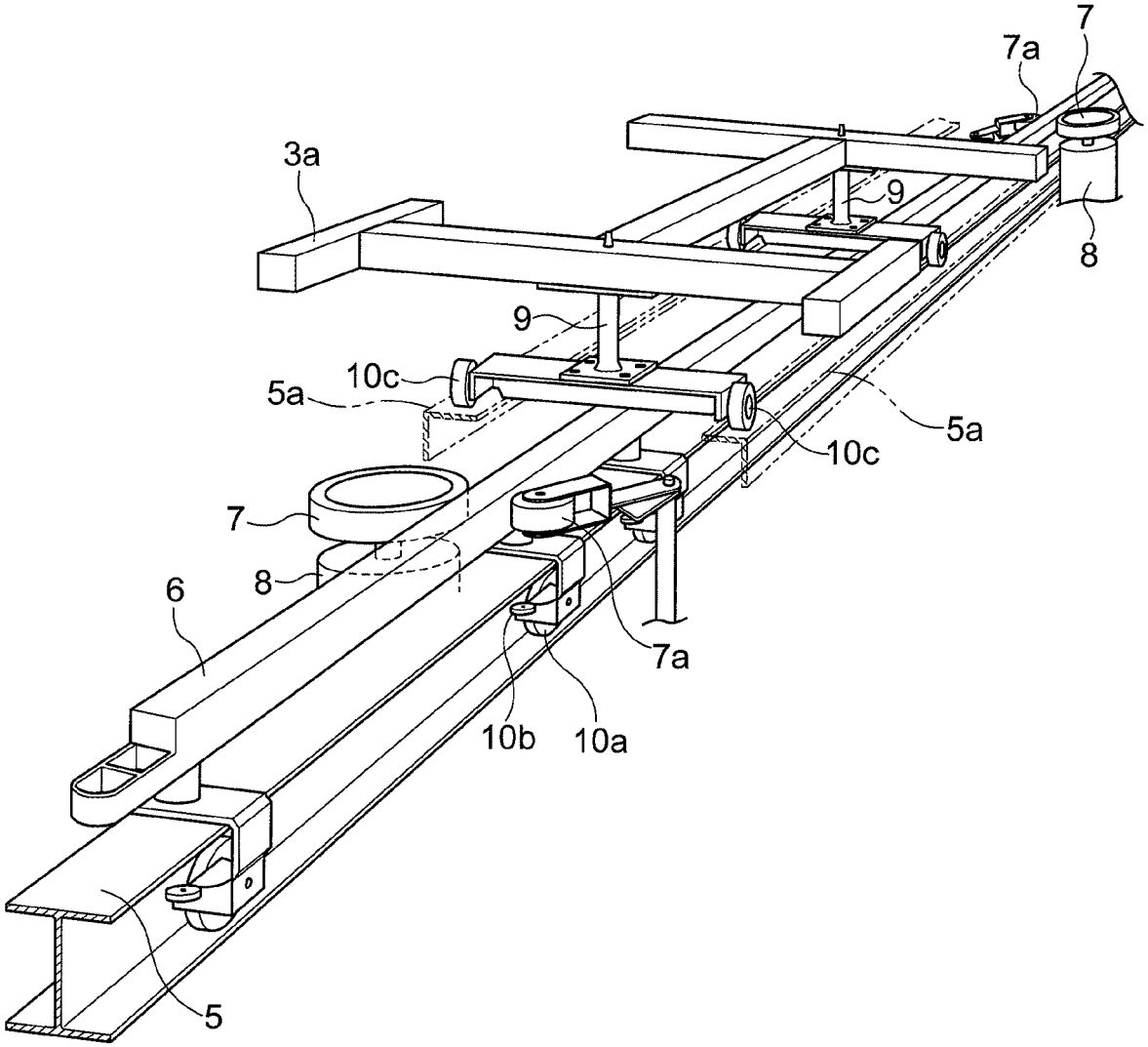
FIG. 3 is a perspective view showing an arrangement of a conveyer device.

The driving section 3*b* of the conveyer device 3, as shown in FIG. 3, includes a main rail 5 which is installed on the bottom portion of the driving section accommodating chamber 4 to extend in the extending direction (namely, the movement direction of the work (W)) of the driving section accommodating chamber 4, a traveling frame 6 movably mounted on the main rail 5, a drive roller 7 which rotates with its circumferential face placed in contact with a later face of the traveling frame 6, and an electric motor 8 for rotating this drive roller 7.

Regarding the traveling frame 6, a plurality of such traveling frames 6 are connected in series and movably mounted on the main rail 5. Further, a plurality of sets of the drive roller 7 and the electric motor 8 are disposed side by side with a predetermined interval in the longitudinal direction of the main rail 5 (namely, the movement direction of the traveling frame 6) and accommodated as such inside the driving section accommodating chamber 4.

On a top face of a front portion and a rear portion respectively of each traveling frame 6, there is vertically mounted a power transmission tool 9 in the form of rod extending upwards and the conveyer cart 3*a* mounting the work (W) thereon is operably coupled to upper end portions of two power transmission tools 9 for each traveling frame 6.

More particularly, as the drive roller 7 is rotated by running of the electric motor 8, due to frictional resistance generated between the circumferential face of the drive roller 7 and the lateral face of the traveling frame 6, the traveling frame 6 travels on the main rail 5 and in association with this, the conveyer cart 3*a* coupled to the traveling frame 6 via the two power transmission tools 9 moves inside the drying chamber 1 along the movement path of the work (W), whereby the work (W) mounted on this conveyer cart 3*a* is conveyed.

That is, the two power transmission tools 9 vertically mounted on each traveling frame 6 are members for transmitting conveying power generated by the driving section 3*b* to the work (W), while being moved with the work (W) by the conveying power generated by the driving section 3*b* of the conveyer device 3 accommodated in the driving section accommodating chamber 4.

Incidentally, the traveling frame 6 mounts a traveling roller 10*a* which rolls on the surface of the main trail 5 and a lower guide roller 10*b* and mounts also upper guide rollers 20*c* which roll on surfaces of a pair of auxiliary rails 5*a* installed in the driving section accommodating chamber 4 and extending parallel with the main rail 5.

Further, at a position opposed to each drive roller 7, there is disposed a guide roller 7*a* which is driven to rotate with its circumferential face being placed in contact with a lateral face on the opposite side of the traveling frame 6.

In a bottom wall 1*a* of the drying chamber 1, there is formed a through hole 11 through which each power transmission tool 9 of the conveyer device 3 extends between the driving section accommodating chamber 4 and the drying chamber 1. This through hole 11 is provided in the form of a slit which extends continuously along the movement path of the work (W) so as to allow each power transmission tool 9 to move along the movement path of the work (W).

A boundary wall portion (K) between the drying chamber 1 and the driving section accommodating chamber 4 (namely, the wall portion of the bottom wall 1*a* of the drying chamber 1 corresponding to the disposing position of the driving section accommodating chamber 4) is divided into a plurality of divided wall portions 12 in the movement direction of the work (W).

And, each one of these divided wall portions 12 consists of a one side portion 12*a* and the other side portion 12*b* across the slit-like through hole 11. And, these one side portion 12*a* and other side portion 12*b* have a door-like arrangement that allows opening thereof in the form of a double door toward the drying chamber 1.

Namely, by opening the one side portion 12*a* and the other side portion 12*b* of each divided wall portion 12 to open up the inside of the driving section accommodating chamber 4 to the drying chamber 1, various kinds of maintenance works for the driving section 3*b* of the conveyer device 3 accommodated in the driving section accommodating chamber 4 can be carried out easily from the side of the drying chamber 1.

Figure 2:
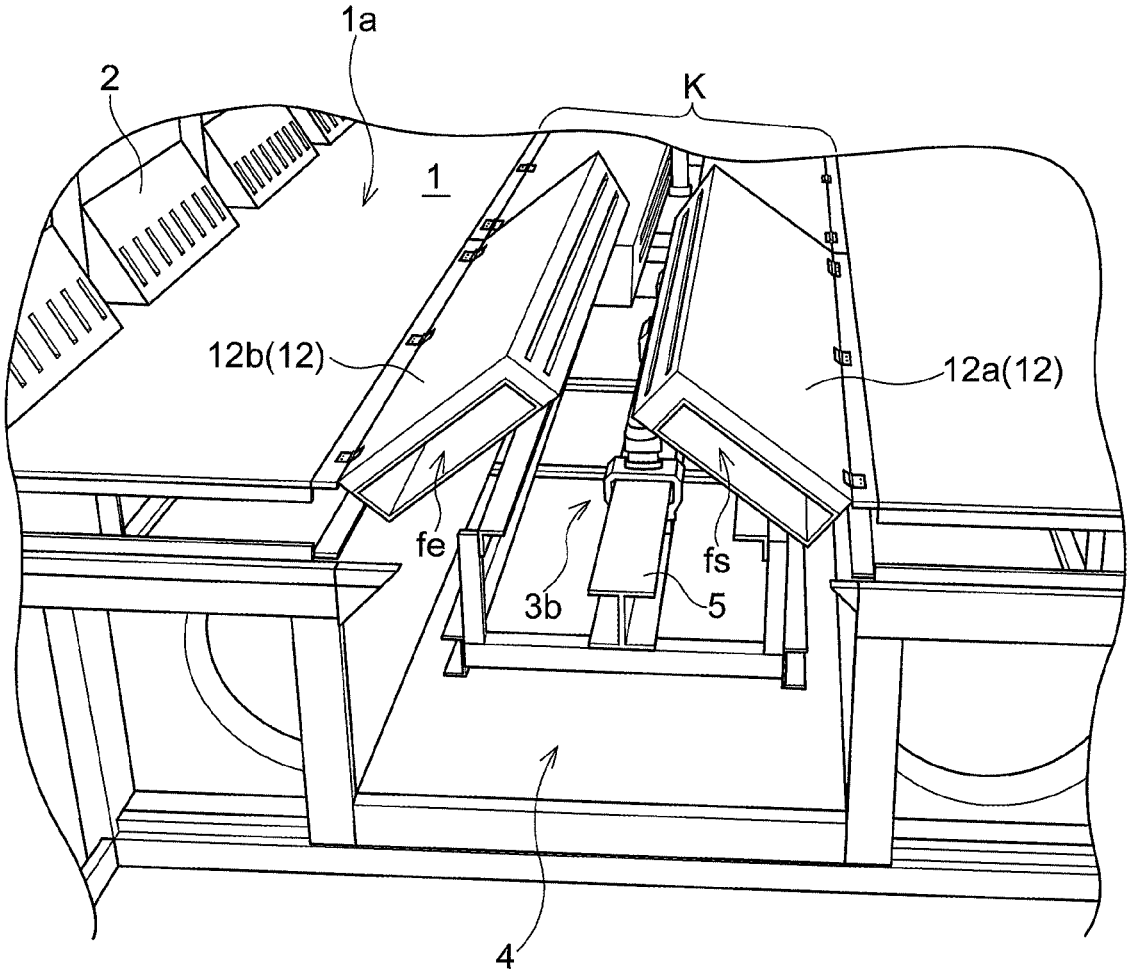
FIG. 2 is a perspective view showing a condition of a boundary wall portion being opened.
Figure 4:
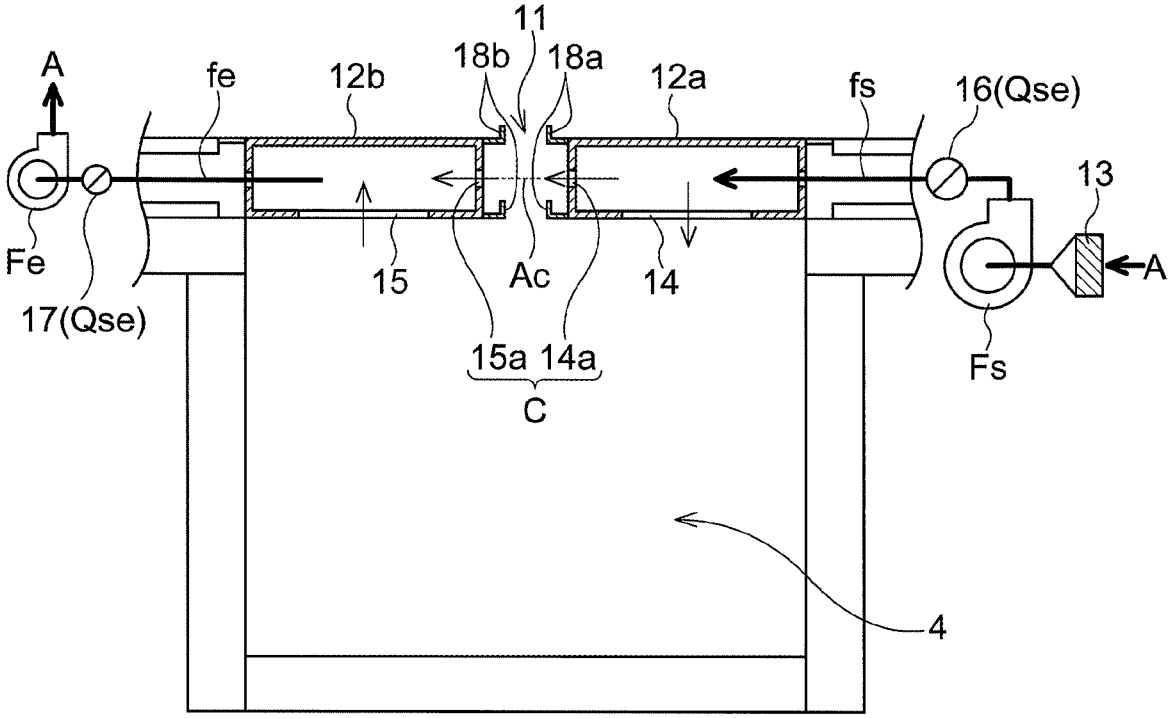
FIG. 4 is a schematic horizontal section of a driving section accommodating chamber.

As shown in FIGS. 1, 2 and 4, in the one side portion 12*a* of the respective divided wall portion 12, the air feeding passage (fs) divided for each divided wall portion 12 is formed as being embedded therein. Similarly, in the other side portion 12*b* of each divided wall portion 12, the exhaust passage (fe) divided for each divided wall portion 12 is formed as being embedded therein.

Namely, by closing all of the one side portions 12*a* formed like a door like arrangement, one continuous air feeding passage (fs) is formed. Whereas, by closing all of the other side portions 12*b* formed like a door like arrangement, one continuous exhaust passage (fe) is formed.

The air feeding passage (fs) is an air passage configured to feed air (A) present outside the drying chamber 1 through a filter 13 to respective portion of the driving section accommodating chamber 4 in its extending direction by means of an air feeding fan (Fs). The exhaust passage (fa) is an air passage configured to exhaust the air (A) introduced from the respective portion in the extending direction of the driving section accommodating chamber 4 by an exhaust fan (Fe) to the outside of the drying chamber 1.

And, at the lower face portion of the one side portion 12*a* of each divided wall portion 12, there is formed an outlet 14 for discharging the air (A) fed via the air feeding passage (fs) downwardly into the driving section accommodating chamber 4. At the lower face portion of the other side portion 12*b* of each divided wall portion 12, there is formed an inlet 15 for introducing the air (A) in the driving section accommodating chamber 4 into the exhaust passage (fe).

Further, at the lateral face portion of the one side portion 12*a* of each divided wall portion 12 on the side of the through hole 11 (in other words, one side hole edge portion in the hole width direction of the through hole 11), there is formed an air-curtain forming outlet 14*a* configured to discharge a portion of the air (A) fed via the air feeding passage (fs) toward the through hole 11.

On the other hand, at the lateral face portion of the other side portion 12*b* of each divided wall portion 12 on the side of the through hole 11 (in other words, the other side hole edge portion in the hole width direction of the through hole 11), there is formed an air-curtain forming inlet 15*a* configured to introduce the air (A) via the through hole 11 into the exhaust passage (fe).

These oppositely disposed air-curtain forming outlet 14*a* and the air-curtain forming inlet 15*a* are both formed like narrow slits, which extend for substantially entire length of each divided wall portion 12 in the extending direction of the slit-like through hole 11. With discharging of the air (A) via the air-curtain forming outlet 14*a* and introducing of the air (A) via the air-curtain forming inlet 15*a*, there is formed an air flow curtain (Ac) which transverses the through hole 11.

Namely, the air-curtain forming outlet 14*a* and the air-curtain forming inlet 15*a* together constitute an air curtain device (C) for forming the air flow curtain (Ac) transversing the through hole 11.

The air feeding passage (fs) incorporates an air feeding side air amount adjustment damper 16 for adjusting the air amount (qs) of the air (A) to be fed into the driving section accommodating chamber 4 via the air feeding passage (fs) and the exhaust passage (fe) incorporates an exhaust side air amount adjustment damper 17 for adjusting the air amount (qe) of the air (A) to be exhausted from the driving section accommodating chamber 4 via the exhaust passage (fe).

More particularly, these feeding side air amount adjustment damper 16 and exhausting side air amount adjustment damper 17 respectively constitutes an air amount ratio adjustment device (Qse) for adjusting the ratio between the air amount (qs) (feeding air amount) of the air (A) to be fed into the driving section accommodating chamber 4 via the air feeding passage (fs) and the air amount (qe) (exhausting air amount) of the air (A) to be exhausted from the driving section accommodating chamber 4 via the exhaust passage (fe).

And, with the paint drying device of this embodiment, by adjusting the ratio between the above-described feeding air amount (qs) and the above-described exhausting air amount (qe) by operating these feeding side air amount adjustment damper 16 and/or the exhausting side air amount adjustment damper 17, the pressure (p4) of the air (A) inside the driving section accommodating chamber 4 is adjusted to be equal to the pressure (p1) of the air (A) of the drying chamber 1 (p4=p1).

Namely, with the paint drying device of this embodiment, with establishment of equalization between the pressure (p4) of the air (A) inside the driving section accommodating chamber 4 and the pressure (p1) of the air (A) of the drying chamber 1, in addition to the shielding effect for the through hole 11 provided by the air curtain (Ac) formed by the air curtain device (C), both leakage of hot air into the driving section accommodating chamber 4 from the drying chamber 1 via the through hole 11 and the inflow of normal temperature air from the driving section accommodating chamber 4 into the drying chamber 1 via the through hole 11 can be prevented effectively.

Further, with the paint drying device of this embodiment, the air (A) is discharged via the outlet 14 formed at the lower face portion of the one side portion 12*a* of each one of the divided wall portions 12 juxtaposed in the extending direction of the driving section accommodating chamber 4 and also the air (A) is introduced via the inlet 15 formed at the lower face portion of the other side portion 12*b* of each one of the divided wall portions 12. Therefore, the air (A) inside the driving section accommodating chamber 4 is effectively stirred throughout in the extending direction of the driving section accommodating chamber 4. With this, local rising of temperature in the driving section accommodating chamber 4 is prevented, so heat damage and heat deterioration of the driving section 3*b* such as the electric motor 8 accommodated in the driving section accommodating chamber 4 can be prevented even more reliably.

At the lateral face portion of the one side portion 12*a* and the other side portion 12*b* of each divided wall portion 12 on the side of the through hole 11, at portions thereof closer to the side of the drying chamber 1 and the side of the driving section accommodating chamber 1 than the air-curtain forming outlet 14*a* or the air-curtain forming inlet 15*a*, there are respectively formed one side adjacent seal member 18*a* and the other side adjacent seal member 18*b* extending to positions adjacent the movement paths of the power transmission tools 9.

Further, these one side and other side adjacent seal members 18*a*,18*b* respectively are provided along the entire length of each divided wall portion 12 and at the leading end portion thereof adjacent the power transmission tool 9, there is provided an upwardly bent portion.

Namely, with the reception of dust or the like by these one side and other side adjacent seal members 18*a*,18*b*, together with the shielding effect provided by the air curtain (Ac) formed by the air curtain device (C), intrusion of dust or the like generated in the drying chamber 1 by dropping into the driving section accommodating chamber 4 via the through hole 11 as well as intrusion of dust or the like generated in the driving section accommodating chamber 4 into the drying chamber 1 via the through hole 11 by being stirred up can be effectively prevented by the air curtain device (C).

In short, in the paint drying device of this embodiment:

there is provided the drying chamber 1 in which a work (W) having paint film formed thereon is accommodated;

in the drying chamber 1, there are provided the heater device 2 for heating and drying the paint film and the conveyer device 3 for moving the work (W);

the conveyer device 3 includes the driving section 3*b* for generating conveying power and the power transmission tool 9 for transmitting the conveying power to the work (W) as being moved together with the work (W) by the conveying power generated by the driving section 3*b;* the driving section accommodating chamber 4 is provided for accommodating the driving section 3*b* by surrounding this driving section 3*b*, the drying chamber 1 and the driving section accommodating chamber 4 being communicated to each other via the through hole 11 through which the power transmission tool 9 extends;

the through hole 11 is formed like a slit extending continuously along the movement path of the work (W) in the drying chamber 1 in order to allow the power transmission tool 9 to move with the work (W);

the air feeding passage (fs) is provided for feeding air (A) present outside the drying chamber 1 to the driving section accommodating chamber 4 by the air feeding fan (Fs);

the exhaust passage (fe) is provided for exhausting the air (A) in the driving section accommodating chamber 4 to the outside of the drying chamber 1 by the exhaust fan (Fe); and the air amount ratio adjustment device (Qse) (16, 17) is provided for adjusting a ratio between the amount (qs) of air (A) fed to the driving section accommodating chamber 4 via the air feeding passage (fs) and the amount (qe) of air exhausted from the driving section accommodating chamber 4 via the exhaust passage (fe).

Further, the output 14*a* for forming air curtain and the inlet 15*a* for forming the air curtain are disposed in opposition to each other and in distribution at a hole edge portion on side in a hole width direction of the through hole 11 and at a hole edge portion on the other side in the hole width direction of the through hole 11; and there is provided the air curtain device C configured to discharge a portion of the air (A) fed by the air feeding fan (Fs) via the air curtain forming outlet 14*a* and to introduce a portion of the air (A) taken in by the exhaust fan Fe via the air curtain forming inlet 15*a*.

Also, there are provided:

an adjacent seal member 18*a* on one side which extends from the hole edge portion on one side in the hole width direction of the through hole 11 to a position adjacent a movement path of the power transmission tool 9; and an adjacent seal member 18*b* on the other wide which extends from the hole edge portion on the other side in the hole width direction of the through hole 11 to a position adjacent the movement path of the power transmission tool 9.

Further, a plurality of the one side adjacent seal member 18*a* and the other side seal member 18*b* are provided in distribution in a hole depth direction of the through hole 11.

Further, at least a portion of the exhaust passage (fe) or at least a portion of the air feeding passage (fs) is disposed to be embedded in a boundary wall portion (K) between the drying chamber 1 and the driving section accommodating chamber 4.

Further, the boundary wall portion (K) (12*a*, 12*b*) in which at least a portion of the exhaust passage (fe) or at least a portion of the air feeding passage (fs) is disposed to be embedded has a door arrangement or a lid arrangement which allows free opening and closing.

Other Embodiments

Next, other embodiments of the present invention will be cited.

FIGS. 5 through 8 all show further embodiments of the present invention. As for the same members as those shown in the foregoing embodiment are denoted with same reference signs as those used in the foregoing embodiment.

In the embodiments shown in FIGS. 5-8, in both the one-side portion 12*a* and the other side portion 12*b* of the respective divided wall portion 12, the exhaust passage (fe) is embedded in each divided wall portion 12.

Namely, each exhaust passage (fe) is formed as one continuous passage by closing all of the one side portions 12*a*, or closing all of the other side portions 12*b*.

And, at the lower face portion of the one side portion 12*a* of each divided wall portion 12 and at the lower face portion of the other side portion 12*b* of each divided wall portion 12, there is formed an inlet 15 for introducing the air (A) in the driving section accommodating chamber 4 into each exhaust passage (fe).

Further, at the lateral face portion of the one side portion 12*a* of each divided wall portion 12 on the side of the through hole 11 (in other words, the one side hole edge portion in the hole width direction of the through hole 11), and at the lateral face portion of the other side portion 12*b* of each divided wall portion 12 on the side of the through hole 11 (in other words, the other side hole edge portion in the hole width direction of the through hole 11), there are formed inlets 15*b* for sealing for introducing a portion of the air (A) introduced by the exhaust fan (Fe) via the through hole 11.

Namely, these sealing inlet 15*b* of the one side portion 12*a* and the sealing inlet 15*b* of the other side portion 12*b* are disposed in opposition across the through hole 11 therebetween, and also both of these are formed like narrow slits extending substantially along the entire length of each divided wall portion 12 in the extending direction of the slit-like through hole 11, and the sealing inlet 15*b* of the one side portion 12*a* and the sealing inlet 15*b* of the other side portion 12*b* together constitute an air seal device (S) for the through hole 11.

Namely, by disposing the sealing inlets 15*b* in opposition across the through hole 11 therebetween as described above, intrusion of dust or the like generated in the drying chamber 1 by dropping into the driving section accommodating chamber 4 via the through hole 11 as well as intrusion of dust or the like generated in the driving section accommodating chamber 4 into the drying chamber 1 via the through hole 11 by being stirred up can be effectively prevented.

Figure 5:
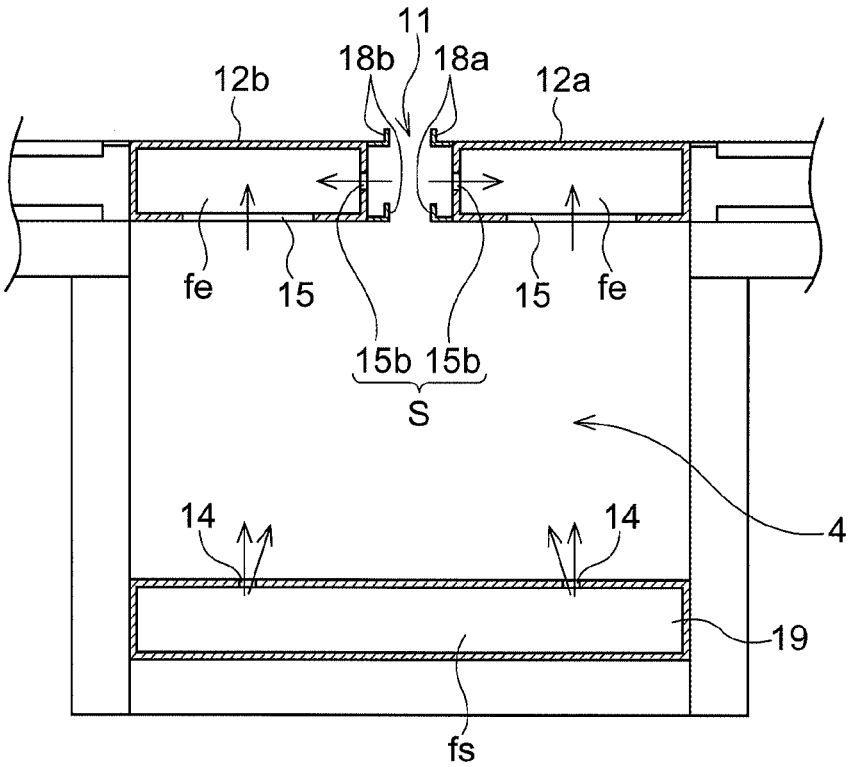
FIG. 5 is a schematic horizontal section showing a driving section accommodating chamber of a further embodiment.

In contrast to the arrangement in which the exhaust passages (fe) are provided in both the one side portion 12*a* and the other side portion 12*b* of each divided wall portion 12, in the case of the example shown in FIG. 5, an air feeding duct 19 forming the air feeding passage (fs) is provided along the extending direction of the driving section accommodating chamber 4, with the duct 19 acting also as a bottom forming member for the driving section accommodating chamber 4.

And, outlets 14 for upwardly discharging the air (A) fed via the air feeding passage (fs) by the air feeding fan (Fs) are formed in an upper face portion of the air feeding duct 19 in juxtaposition with an appropriate spacing in the extending direction of the driving second accommodating section 4 (i.e. the moving direction of the work (W)).

Figure 6:
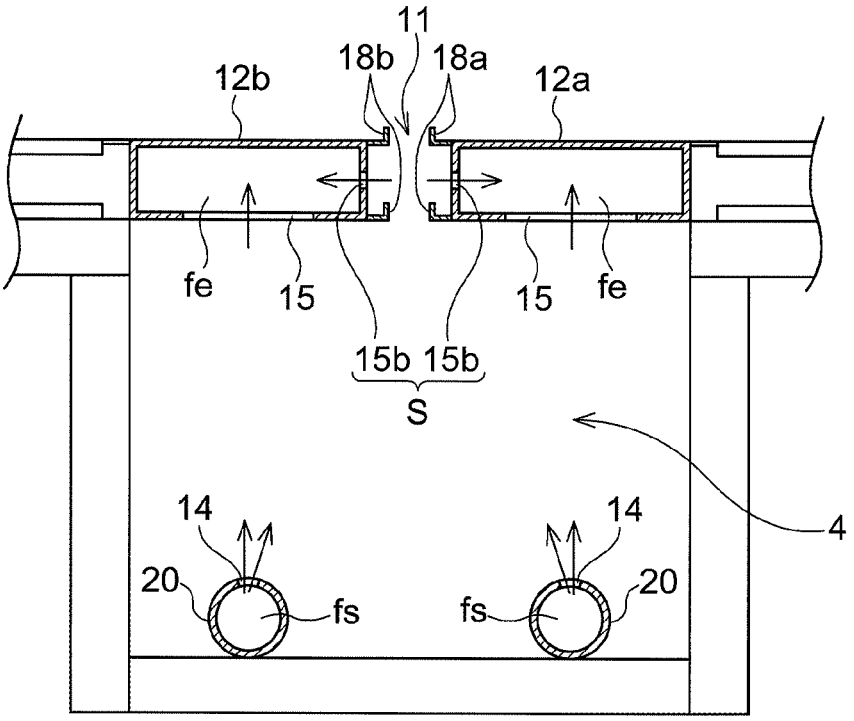
FIG. 6 is a schematic horizontal section showing a driving section accommodating chamber of a further embodiment.

On the other hand, in the example shown in FIG. 6, a plurality of air feeding pipes 20 forming the air feeding passage (fs) are accommodated in the driving section accommodating chamber 4 in juxtaposition along the extending direction of the driving section accommodating chamber 4 and extending along the extending direction of the driving section accommodating chamber 4. And, the outlets 14 for upwardly discharging the air (A) fed via the air feeding passage (fs) by the air feeding fan (Fs) are formed int eh respective air feeding pipes 20 in juxtaposition with an appropriate spacing in the extending direction of the driving section accommodating chamber 4 (i.e. the moving direction of the work (W)).

Figure 7:
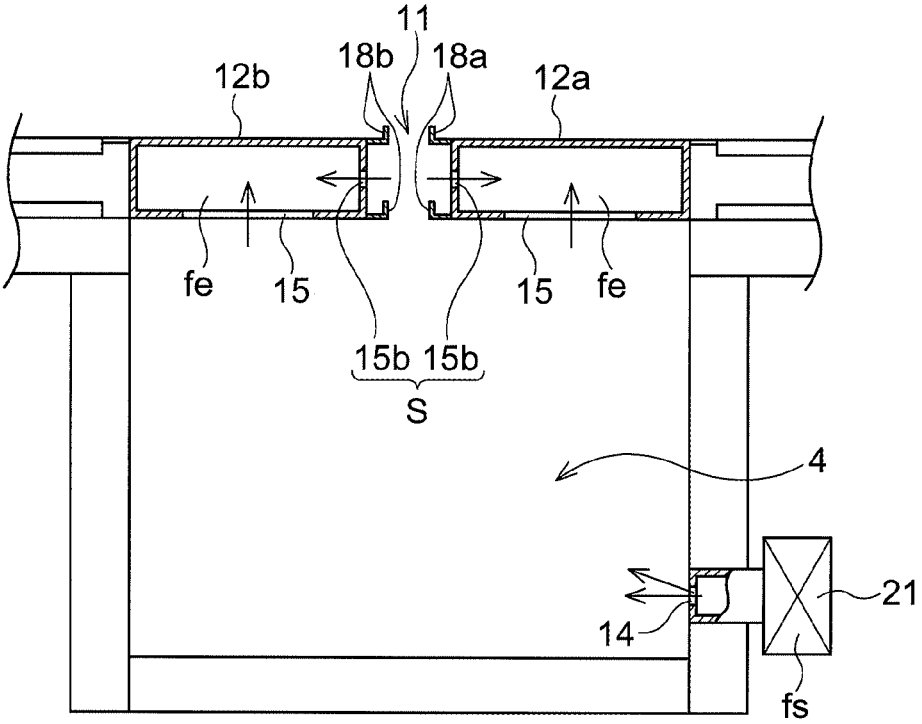
FIG. 7 is a schematic horizontal section showing a driving section accommodating chamber of a further embodiment.

Further, in the example shown in FIG. 7, an ambient air feeding duct 21 forming the air feeding passage (fs) is provided outside the driving section accommodating chamber 4 along the extending direction of this driving section accommodating chamber 4.

And, the outlets 14 for discharging the air (A) fed via the air feeding passage (fs) by the air feeding fan (Fs) are formed in the lateral wall portion (or the bottom wall portion) of the driving section accommodating chamber 4 in juxtaposition with an appropriate spacing in the extending direction of the driving section accommodating chamber 4 (i.e. the moving direction of the work (W)).

Incidentally, pressure loss which occurs until the air discharged from the outlets 14 reaches the inlets 15 can be a cause for a pressure difference which may occur between the driving section accommodating chamber 4 and the drying chamber 1. Thus, the juxtaposition spacings of the outlets 14 and the outlets 15 respectively in the extending direction of the driving section accommodating chamber 4 and the relative positional relationship between the outlets 14 and the inlets 15 will be determined such that leaking-in and leaking-out amounts of the air via the through hole 11 between the driving section accommodating chamber 4 and the drying chamber 1 which may be caused by such pressure loss between the outlets 14 and the inlets 15 may be confined within an allowable range.

In all of these examples shown in FIGS. 5 through 7, by operating an air feeding side air amount adjustment damper 16 or the exhausting side air amount adjustment damper 17 for equalizing the pressure (p4) of the air (A) in the driving section accommodating chamber 4 and the pressure (p1) of the air in the drying chamber 1, in addition to the introduction of the air (A) via the sealing inlets 15*b* provided across the through hole 11, leakage of hot air via the through hole 11 from the drying chamber 1 to the driving section accommodating chamber 4 as well as inflow of normal temperature air via the through hole 11 from the driving section accommodating chamber 4 to the drying chamber 1 can be prevented effectively.

Further, with the discharging of air (A) from the outlets 14 and the introducing of air (A) from the inlets 15, the air (A) inside the driving section accommodating chamber 4 can be stirred effectively entirely along the extending direction of the driving section accommodating chamber 4, whereby local temperature rise in the driving section accommodating chamber 4 can also be prevented effectively.

Figure 8:
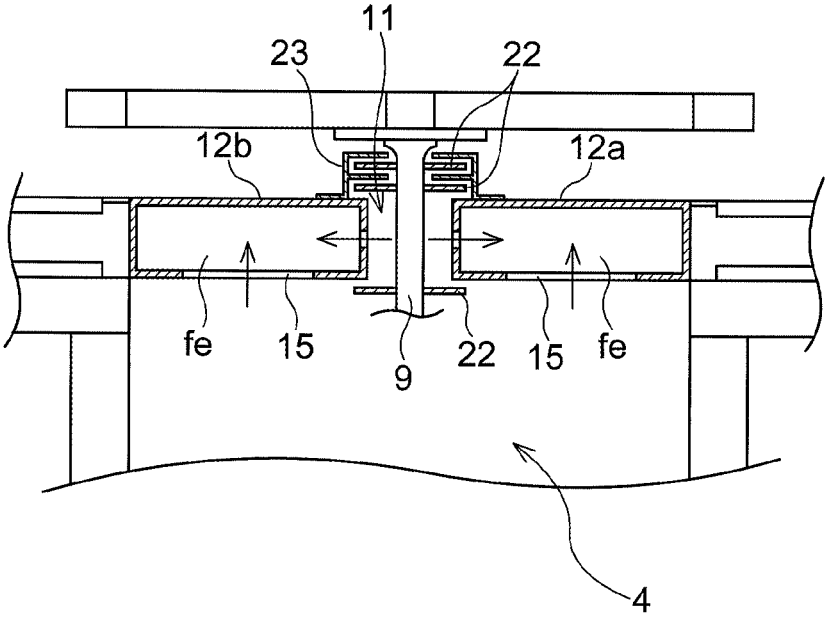
FIG. 8 is a schematic horizontal section showing a driving section accommodating chamber of a further embodiment.

On the other hand, in the example shown in FIG. 8, as a sealing means for the through hole 11, in place of the one side and the other side adjacent seal members 18*a*, 18*b* shown in the foregoing embodiment, there are provided a moving side seal member 22 to be attached to the power transmission tool 9 and a cover seal member 23 for covering this moving side seal member 22.

The moving side seal member 22 is formed of a plate member having a greater width than the hole width of the through hole 11 and a plurality of (or one) stages of such moving side seal members 22 are attached to the power transmission tool 9 at positions adjacent the hole openings of the through hole 11 on the side of the driving section accommodating chamber 4. Further, at positions adjacent the hole openings of the through hole 11 on the side of the driving section accommodating chamber 4, one or a plurality of stages of moving side seal members 22 are attached to the power transmission tool 9.

And, these moving side seal members 22 have a length corresponding to the length of the traveling frame 6, in this embodiment.

In contrast, to the one side member 12*a* and the other side member 12*b* of each divided wall portion 12, at positions adjacent the hole opening of the through hole 11, as seen in the direction of the extending direction of the through hole 11, there is attached a cover seal member 23 which surrounds the each stage of moving side seal member 22 (or each stage of moving side seal member 22 on the side of the driving section accommodating chamber 4) on the side of the drying chamber 1.

And, this cover seal member 23 is provided along the entire length of each divided wall portion 12 in the extending direction of the through hole 11 (i.e. the moving direction of the work (W)), so that when all of the one side portions 12*a* or all of the other side portions 12*b* are closed, the cover seal member 23 extends continuously along the entire length in the extending direction of the through hole 11.

With provision of these moving side seal member 22 and cover seal member 23, the intrusion of dust or the like via the through hole 11 from the drying chamber 1 to the driving section accommodating chamber 4 and the intrusion of dust or the like via the through hole 11 from the driving section accommodating chamber 4 to the drying chamber 1 can be prevented effectively.

In the foregoing embodiment, there was disclosed an example employing the friction type conveyer device 3. However, embodiment of the present invention does not limit the conveyer device 3 to such friction type conveyer device. The conveyer device 33 can be any type of conveyer device as long it is a conveyer device requiring the power transmission tool 9, such as a chain type conveyer device in which the power transmission tool 9 is coupled with an endless rotary chain, a self-propelled type conveyer device in which the power transmission tool 9 is coupled to a self-propelled vehicle, etc.

In the foregoing embodiment, there was disclosed an example in which as the air feeding side air amount adjustment damper 16 and the exhausting side air amount adjustment damper 17 are employed as the air amount adjustment device (Qse) for adjusting a ratio between the feeding air amount (qs) to the driving section accommodating chamber 4 and the exhausting air amount (qe) from the driving section accommodating chamber 4. Alternatively, however, the ratio between the feeding air amount (qs) to the driving section accommodating chamber 4 and the exhausting air amount (qe) from the driving section accommodating chamber 4 can be adjusted through e.g. inverter control of an output of the air feeding fan (Fs) or the exhaust fan (Fe), with using the air feeding fan (Fs) and/or the exhaust fan (Fe) as the air amount adjustment device (Qse).

Also, for pressure equalization between the air pressure (p4) of the driving section accommodating chamber 4 and the air pressure (p1) of the drying chamber 1, there may be provided a pressure equalization device configured to automatically equalize the air pressure (p4) of the driving section accommodating chamber 4 with the air pressure (p1) of the drying chamber 1 by controlling the air amount ratio adjustment device (Qse) based on detection information of these pressures (p4, p1).

In the foregoing embodiment, there was disclosed an example in which the through hole 11 is formed in the bottom wall 1*a* of the drying chamber 1. However, the present invention is applicable also to a paint drying device in which the through hole 11 is formed in a lateral wall or a ceiling wall of the drying chamber 1.

Further, in the foregoing embodiment, there was disclosed an example in which an automobile body is used as the work (W). However, the present invention is applicable also to a paint drying device in which any article such as an automobile part, an electrically powered instrument, or a track car or an airplane, etc. is used as the work (W).

INDUSTRIAL APPLICABILITY

The present invention may be used in various types of paint drying device having a through hole for a power transmission tool.

DESCRIPTION OF REFERENCE SIGNS

W: work
1: drying chamber
2: heater device
3: conveyer device
3*b*: driving section
9: power transmission tool
4: driving section accommodating chamber
11: through hole
A: air
Fs: air feeding fan
fs: air feeding passage
Fe: exhaust fan
fe: exhaust passage
qs: air amount (feeding air amount)
qe: air amount (exhausting air amount)
Qse: air amount ratio adjustment device
14*a*: air curtain forming outlet
15*a*: air curtain forming inlet
C: air curtain device
15*b*: sealing inlet
S: air seal device
18*a*: one side adjacent seal member
18*b*: other side adjacent seal member
22: moving side seal member
23: cover seal member
K: boundary wall portion

The invention claimed is:

1. A paint drying device, wherein:

a drying chamber is provided for accommodating a work having a paint film formed on its surface;

in the drying chamber, there are mounted a heater device for heating and drying the paint film and a conveyor device for moving the work;

the conveyor device includes a driving section for generating a conveying power, and a power transmission tool configured to transmit the conveying power to the work while moving together with the work by the conveying power generated by the driving section;

a driving section accommodating chamber is provided for accommodating the driving section by surrounding it, the drying chamber and the driving section accommodating chamber being communicated to each other via a through hole through which the power transmission tool is extended; and the through hole is provided in a form of a slit extending continuously along a movement path of the work in the drying chamber in order to allow the movement of the power transmission tool with the work;

wherein an air feeding passage is provided for feeding air present outside the drying chamber to the driving section accommodating chamber by an air feeding fan;

an exhaust passage is provided for exhausting air present inside the driving section accommodating chamber to the outside of the drying chamber by an exhaust fan; and the paint drying device is capable of: (i) selectively operating an air feeding side air amount adjustment damper incorporated in the air feeding passage and/or an exhaust side air amount adjustment damper incorporated in the exhaust passage; or (ii) selectively adjusting an output of the air feeding fan and/or an output of the exhaust fan so as to adjust a ratio between an amount of air fed to the driving section accommodating chamber via the air feeding passage and an amount of air exhausted from the driving section accommodating chamber via the exhaust passage for adjustment of a pressure of the air in the driving section accommodating chamber and equalization of the pressure of the air in the driving section accommodating chamber with a pressure of air in the drying chamber.

2. The paint drying device of claim 1, wherein a pressure equalization control device is provided for automatically equalizing the pressure of the air in the driving section accommodating chamber with the pressure of the air in the drying chamber by: (i) operating the air feeding side air amount adjustment damper and/or the exhaust side air amount adjustment damper; or (ii) adjusting the output of the air feeding fan and/or the output of the exhaust fan based on detection information on the pressure of air in the driving section accommodating chamber and the pressure of the air in the drying chamber.

3. The paint drying device of claim 1 or 2, wherein:

an outlet for forming an air curtain and an inlet for forming the air curtain are disposed opposite to each other and in distribution at a hole edge portion on one side in a hole width direction of the through hole and at a hole edge portion on the other side in the hole width direction of the through hole; and there is provided an air curtain generator configured to discharge a portion of the air fed from the air feeding fan via the air curtain forming outlet and to take in a portion of the air taken in by the exhaust fan via the air curtain forming inlet.

4. The paint drying device of claim 1 or 2, wherein:

inlets for sealing are disposed respectively at a hole edge portion on one side in the hole width direction of the through hole and at a hole edge portion on the other side; and there is provided an air seal device into which a portion of air introduced by the exhaust fan is sucked into the respective sealing inlet.

5. The paint drying device of claim 1 or 2, further comprising:

an adjacent seal member on one side which extends from a hole edge portion on one side in the hole width direction of the through hole to a position adjacent a movement path of the power transmission tool; and an adjacent seal member on the other side which extends from a hole edge portion on the other side in the hole width direction of the through hole to a position adjacent the movement path of the power transmission tool.

6. The paint drying device of claim 5, wherein a plurality of the one side adjacent seal member and the other side seal member respectively are provided in distribution in a hole depth direction of the through hole.

7. The paint drying device of claim 1 or 2, wherein a moving side seal member having a greater width than a hole width of the through hole is provided to the power transmission tool, at a position adjacent a hole opening of the through hole on a side of the drying chamber and/or a position adjacent a hole portion of the through hole on a side of the driving section accommodating chamber.

8. The paint drying device of claim 7, wherein a cover seal member which covers the moving side seal member as seen in the direction of movement of the power transmission tool is provided in continuation in an extending direction of the through hole and at a boundary wall portion between the drying chamber and the driving section accommodating chamber.

9. The paint drying device of claim 1 or 2, wherein at least a portion of the exhaust passage or at least a portion of the air feeding passage is disposed to be embedded in a boundary wall portion between the drying chamber and the driving section accommodating chamber.

10. The paint drying device of claim 9, wherein the boundary wall portion in which at least a portion of the exhaust passage or at least a portion of the air feeding passage is disposed to be embedded has a door arrangement or a lid arrangement which allows free opening and closing.

* * * * *